US006534191B2

(12) United States Patent
Yamauchi

(10) Patent No.: US 6,534,191 B2
(45) Date of Patent: Mar. 18, 2003

(54) SINTERED ALLOY AND METHOD FOR THE HARDENING TREATMENT THEREOF

(75) Inventor: Toshio Yamauchi, Hamamatsu (JP)

(73) Assignee: Suzuki Motor Corporation (JP)

( * ) Notice: Subject to any disclaimer, the term of this patent is extended or adjusted under 35 U.S.C. 154(b) by 0 days.

(21) Appl. No.: 09/770,419

(22) Filed: Jan. 26, 2001

(65) Prior Publication Data

US 2001/0012490 A1 Aug. 9, 2001

(30) Foreign Application Priority Data

Jan. 28, 2000 (JP) ..... 2000-019424

(51) Int. Cl.[7] ..... C22C 33/02; C22C 33/04

(52) U.S. Cl. ..... 428/550; 428/553; 419/27; 419/29

(58) Field of Search ..... 419/26, 45, 46, 419/8, 27, 29; 428/550, 553

(56) References Cited

U.S. PATENT DOCUMENTS 2,192,792 A * 3/1940 Kurtz ..... 75/22
2,633,628 A * 4/1953 Bartlett ..... 29/156.8
3,214,270 A * 10/1965 Valyi ..... 75/201
3,652,261 A * 3/1972 Tubenblat ..... 75/0.5 R
3,681,063 A * 8/1972 Douglass ..... 75/208
3,729,794 A * 5/1973 Douglas ..... 29/182.1
3,755,090 A * 8/1973 Jackson et al. ..... 204/34
3,884,729 A * 5/1975 Jackson et al. ..... 148/11.5 A
3,904,789 A * 9/1975 Speirs et al. ..... 427/253
4,168,162 A * 9/1979 Shafer ..... 75/252
4,286,987 A * 9/1981 Matthews ..... 75/252
4,421,717 A * 12/1983 Rao ..... 419/27
4,970,049 A * 11/1990 Baker et al. ..... 419/11
5,024,889 A * 6/1991 Loszewski ..... 428/368
5,082,433 A * 1/1992 Leithner ..... 419/11
5,352,538 A * 10/1994 Takeda et al. ..... 428/553
5,812,926 A * 9/1998 Wukusick et al. ..... 428/548
5,848,349 A * 12/1998 Newkirk et al. ..... 419/10
5,858,056 A * 1/1999 Fujine et al. ..... 75/236

FOREIGN PATENT DOCUMENTS

JP 61044152 A 3/1986 ..... C22C/33/02

OTHER PUBLICATIONS

ASM Handbook, 9th ed., vol. 7, pp. 554, 1984.*

* cited by examiner

*Primary Examiner*—Daniel J. Jenkins
(74) *Attorney, Agent, or Firm*—Myers Bigel Sibley & Sajovec

(57) ABSTRACT

A method for the hardening treatment of a sintered alloy includes compressing an iron-based sinterable material to form a compact, providing a surface of the compact with a coating material containing aluminum or an aluminum alloy that melts at a temperature lower than the sintering temperature of the compact, and sintering the compact provided with the coating material, so as to form an intermediate compound of iron and aluminum in a surface layer of the compact.

7 Claims, 5 Drawing Sheets

SINTERED ALLOY AND METHOD FOR THE HARDENING TREATMENT THEREOF

RELATED APPLICATION

This application claims priority to Japanese Patent Application No. 2000-019424, filed Jan. 28, 2000.

BACKGROUND OF THE INVENTION

1. Field of the Invention

This invention relates to sintered alloys and a method for the hardening treatment thereof. More particularly, it relates a treatment method which permits iron-based sintered articles to be hardened either wholly or locally and which can be applied especially to synchronizer hubs and like components for use in the transmissions of four-wheeled vehicles.

2. Description of the Related Art

Roughly speaking, the following two methods for improving the wear resistance of an iron-based sintered alloy have been known in the prior art.

(1) A first method is one for hardening the whole of a sintered alloy or one for hardening a sliding part of a sintered alloy by infiltrating an impregnant into the whole of the sliding part.

Specific examples thereof include (a) a method for the hardening treatment of a compact in which, in the formation of a compact by compressing an iron-based sinterable powder, the composition of the whole compact is modified by increasing the contents of C, Cr, Mo, V and other elements constituting the sinterable powder, (b) a method for hardening a sintered alloy by a heat treatment such as quenching or tempering, and (c) a method which comprises infiltrating a copper impregnant into a sintered alloy as disclosed in Japanese Patent Provisional Publication No. 61-44152.

(2) Another method is one for hardening a portion of a sintered alloy or one for hardening a sliding part of a sintered alloy by infiltrating an impregnant into a portion of the sliding part.

Specific examples thereof include (a) a heat treatment method based on induction hardening, and (b) a method which comprises compacting and sintering a sinterable powder while varying the composition of the sinterable powder locally so that the composition of some parts of the compact will differ from that of other parts.

However, the above-described conventional methods for the hardening treatment of a sintered alloy have the following problems.

(1) In the methods based on a heat treatment, a compact is heated again after being sintered, so that the sintered alloy tends to become distorted. Consequently, the sintered ally requires an additional examination of its dimensions and an additional adjustment of its dimensional accuracy, which tends to increase the number of steps.

(2) In the methods which involve varying the composition of the sinterable powder, the powder control for changing the sinterable powder according to the type of the sintered alloy causes an increase in the number of steps. Moreover, since it is necessary to set particular sintering conditions for each sintered alloy, various types of sintered alloys cannot be produced simultaneously.

(3) The methods which involves infiltrating a copper impregnant into a sintered alloy within a sintering furnace are efficient from the viewpoint of thermal energy and production control. However, difficulties are encountered in treating a sintered alloy locally. Moreover, its hardness cannot be increased to the fullest extent and, therefore, its wear resistance has a certain limit.

By way of example, for synchronizer hubs for use in the transmission gears of four-wheeled vehicles, iron-based sintered articles are often used from the viewpoint of uniaxial configuration and strength. However, in the as-sintered state, these articles have low hardness and hence exhibit insufficient wear resistance. Although they may be subjected to a heat treatment such as induction quenching after sintering, this requires additional thermal energy and causes an increase in manufacturing cost.

Accordingly, in order to solve the above-described problems, it would be necessary to apply a hardening treatment to only a sliding part of a sintered article instead of the whole of the sintered article, and carry out this hardening treatment at the same time as the sintering.

SUMMARY OF THE INVENTION

An object of the present invention is to solve the above-described problems by providing sintered alloys in which only a sliding part can be hardened without altering the dimensional accuracy of the article, and a method for the hardening treatment thereof.

In order to accomplish the above object, the present invention includes the following three embodiments.

(Embodiment 1) First of all, the present invention relates to a method for the hardening treatment of a sintered alloy which comprises the steps of compressing an iron-based sinterable material to form a compact; providing a surface of the compact with a coating material containing aluminum or an aluminum alloy that melts at a temperature lower than the sintering temperature of the compact; and sintering the compact provided with the coating material, so as to form an intermetallic compound of iron and aluminum in a surface layer of the compact.

According to the above-described method, a hardening treatment for forming an intermetallic compound can be applied to not only the whole of a sintered alloy, but also only a part of a sintered alloy (e.g., a part thereof required for use as a sliding site). Moreover, the present invention can eliminate the necessity for an after-treatment such as quenching, and thereby save labor. Consequently, an enhancement in the efficiency of thermal energy required for sintering and an improvement in the dimensional accuracy of the resulting sintered alloy can be achieved. Furthermore, even when a compact is to be hardened locally, it can be treated under the same conditions as employed commonly for sintering purposes, without adding to an amount of work required for the hardening treatment.

(Embodiment 2) Moreover, the present invention relates to a method for the hardening treatment of a sintered alloy in accordance with the above-described Embodiment 1 wherein the coating material comprises a dispersion of a powder of aluminum or an aluminum alloy in a solvent or a member formed of aluminum or an aluminum alloy.

According to the above-described method, while the compact is sintered to form a sintered alloy, a portion of the aluminum component present in the coating material penetrates from the surface of the compact into a plurality of pores formed in the compact. On the other hand, the iron component present in the compact also penetrates into the coating material. Consequently, a reaction takes place between the aluminum component of the coating material and the iron component of the compact, so that an intermetallic compound is formed in a surface layer of the sintered alloy. This intermetallic compound has very high hardness and wear resistance, and hence exhibits characteristic suitable for use as a sliding part. Moreover, since the intermetallic compound is a porous body having a multitude of pores or the like, it allows oil and the like to accumulate therein and hence serves to reduce the sliding resistance.

(Embodiment 3) Furthermore, the present invention relates to a sintered alloy having been subjected to a hardening treatment according to the method of the above-described Embodiment 1 or 2.

The present invention makes it possible to apply a hardening treatment to not only the whole of a sintered alloy, but also only a part of a sintered alloy (e.g., a part thereof required for use as a sliding site). Moreover, the present invention can eliminate the necessity for an after-treatment such as quenching, and thereby save labor.

DETAILED DESCRIPTION OF PREFERRED EMBODIMENTS

Sintered alloys in accordance with the present invention and the method for the hardening treatment thereof are more specifically described hereinbelow with reference to the accompanying drawings.

According to the present invention, an iron-based sintered alloy is made by compressing a sinterable powder to form a compact, placing a coating material comprising an appropriate amount of aluminum or an aluminum alloy on a part of the compact (i.e., a part thereof to be hardened), and sintering this assembly by the application of heat so as to produce an iron-based sintered article. Thus, an intermetallic compound of aluminum and iron can be formed in a surface layer of the sintered alloy.

[Steps of Hardening Treatment]

(1) Formation of a Compact

First of all, an iron-based sinterable powder is compressed to form a compact. This sinterable powder contains not less than 90% by weight of the Fe component, and preferably has a particle diameter of 20 to 200 $\mu$m. No particular limitation is placed on the type of the aforesaid sinterable powder, and there may be used any of various sinterable powders as specified in JIS. For example, iron-based sinterable powders specified in the SMF Types 3, 4 and 5 of JIS may preferably be used.

(2) Application of a Coating Material

Figure 1:
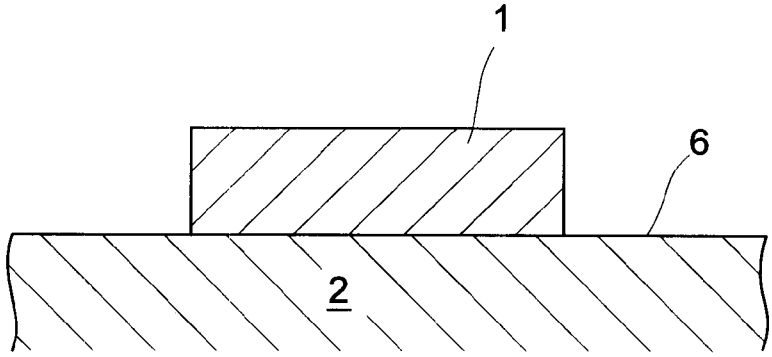
FIG. 1 is a cross-sectional view of a compact on which a small-sized member formed of an aluminum alloy is placed.

Then, a coating material comprising aluminum or an aluminum alloy is applied to the compact. This can be accomplished, for example, by applying a coating material comprising a dispersion of a powder of aluminum or an aluminum alloy in a solvent to the compact (e.g., with a brush), or by placing a coating material comprising a small-sized member 1 formed of aluminum or an aluminum alloy on a surface of the compact 2 as illustrated in FIG. 1, and heating the compact 2 to melt the small-sized member 1.

(3) Sintering

The compact 2 having the coating material applied thereto is sintered by means of a conventional sintering furnace. The sintering temperature is generally in the range of 1,000 to 1,300° C., and the melting point of aluminum or the aluminum alloy in the coating material is lower than the aforesaid sintering temperature.

(3-1) Penetration of the Aluminum Component of the Coating Material into the Compact 2

Figure 2:
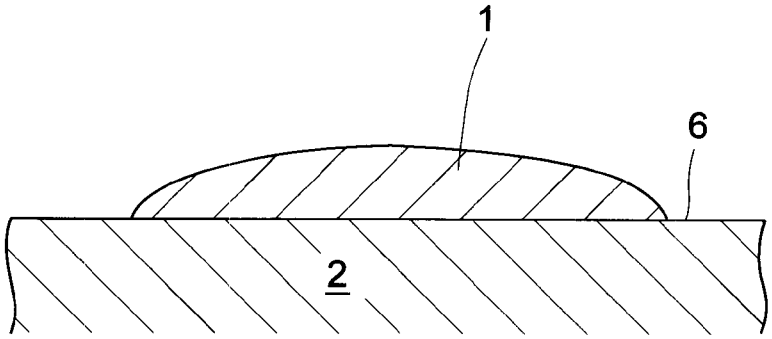
FIG. 2 is a cross-sectional view illustrating the state in which the small-sized member placed on the compact begins to melt.
Figure 3:
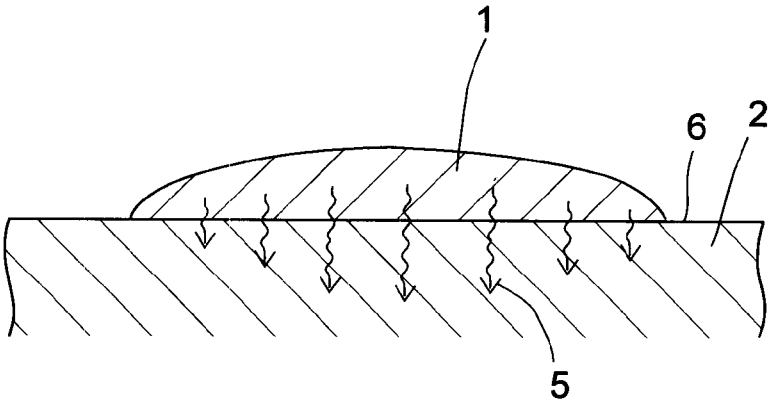
FIG. 3 is a cross-sectional view illustrating the state in which the aluminum component present in the small-sized member placed on the compact melts and penetrates into the compact.
Figure 5:
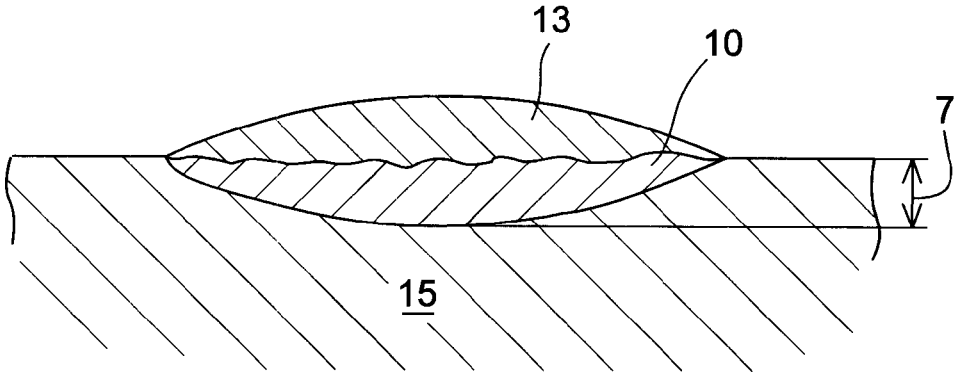
FIG. 5 is a cross-sectional view illustrating an intermetallic compound formed in the surface region of the compact.

As illustrated in FIG. 2, the small-sized member 1 constituting the coating material begins to melt at the aforesaid sintering temperature. Then, as illustrated in FIG. 3, a portion of the aluminum component 5 present in the molten small-sized member 1 penetrates from surface of the compact 2 into fine pores (or voids) formed in the compact 2. Thus, a reaction takes place between the aluminum component 5 of the small-sized member 1 and the iron component of the compact 2. Consequently, as illustrated in FIG. 5, an intermetallic compound 10 is formed in a surface layer 7 having a certain depth from the surface of the compact 2.

Figure 4:
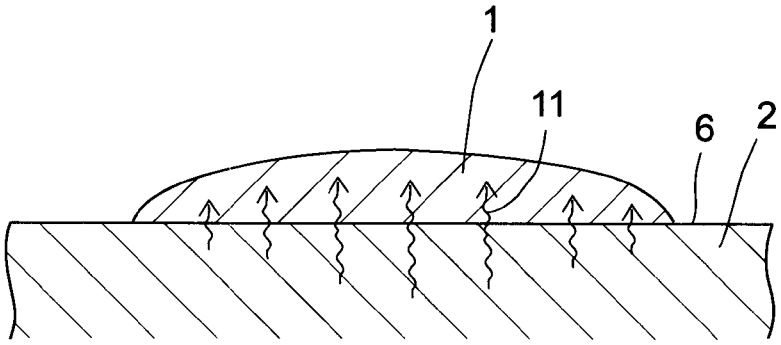
FIG. 4 is a cross-sectional view illustrating the state in which the iron component present in the compact penetrates into the small-sized member.

(3-2) Penetration of the Iron Component of the Compact 2 into the Coating Material On the other hand, as illustrated in FIG. 4, the iron component 11 present in the compact 2 also penetrates into the small-sized member 1. Thus, a reaction also takes place between the aluminum component 5 present in the small-sized member 1 and the iron component 11 having migrated from the compact 2. Consequently, as illustrated in FIG. 5, an intermetallic compound 13 is also formed in the small-sized member 1 placed on the surface 6 of the compact 2. Accordingly, as illustrated in FIG. 5, while the compact 2 is sintered to form a sintered alloy 15, intermetallic compounds 13 and 10 precipitate simultaneously in both the small-sized member 1 placed on the surface 6 of the sintered alloy 15 and the surface layer 7 thereof, and these intermetallic compounds 13 and 10 are combined together.

(4) Cooling

Figure 6:
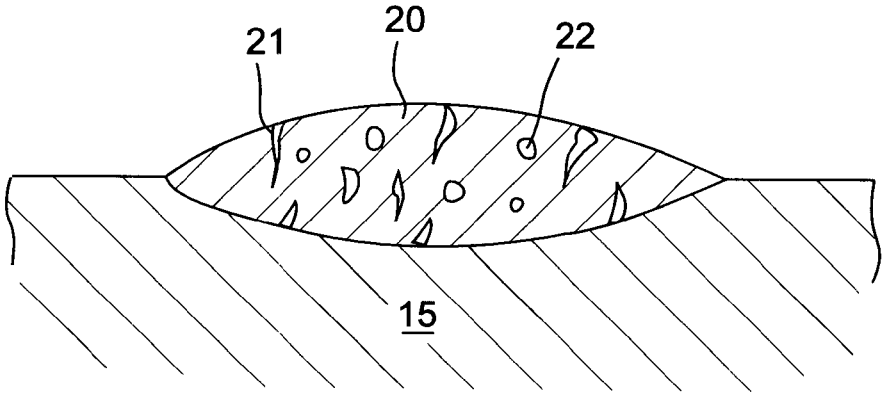
FIG. 6 is a cross-sectional view illustrating the intermetallic compound which has undergone a volume shrinkage as a result of cooling.

Finally, the aforesaid sintered alloy 15 is cooled. As illustrated in FIG. 6, this cooling causes the combined intermetallic compound 20 to undergoes a volume shrinkage, so that the intermetallic compound 20 forms a porous body having cracks 21 and pores 22 therein.

[Coating Material]

The coating material used in the present invention contains aluminum or an aluminum alloy. Specifically, there may be used, for example, a dispersion of a powder of aluminum or an aluminum alloy in a solvent, or a small-sized member formed of aluminum or an aluminum alloy. When a powder of aluminum or an aluminum alloy is used, its particle diameter is preferably in the range of 10 to 100 μm. As to the alloy composition, useful alloys include, for example, Al—Cu, Al—Mg, Al—Si and Al—Zn alloys. Moreover, ternary and higher multicomponent alloys obtained by combining the foregoing alloys are also useful. Furthermore, there may also be used pure aluminum and other aluminum alloys.

The metallic aluminum present in the coating material needs to melt at the sintering temperature of the compact 2 without fail. Accordingly, it is preferable to use a coating material in which the aluminum or aluminum alloy melts at a temperature that is about 100° C. lower than the sintering temperature of the compact 2. Since the sintering temperature for common iron-based sintered alloys is in the range of 1,000 to 1,300° C., the melting temperature of the aluminum or aluminum alloy present in the aforesaid coating material should be lower than the sintering temperature and preferably about 200° C. lower than the sintering temperature.

[Compact]

The compact 2 used in the present invention is a porous body having a plurality of interconnected fine pores (or voids) formed therein. As described above, no particular limitation is placed on the type of the sinterable powder used to form this compact 2, and there may be used any of various iron-based as specified in JIS.

The present invention is further illustrated by the following example.

EXAMPLE 1

First of all, a powder mixture (corresponding to JIS SMF5030) was prepared by mixing 0.7% of powdered carbon, 1% of powdered Cu, 1% of powdered Ni, and the balance comprising powdered iron. Then, this iron-based powder mixture was compressed so as to give a sintered density of 6.9 g/cm$^3$.

A small-sized member (coating material) 1 formed of an aluminum alloy (i.e., Al—40% Cu) was placed on the aforesaid compact 2. This assembly was inserted into a sintering furnace having a temperature of 1,150° C. and held at the maximum temperature for 15 minutes.

Figure 7:
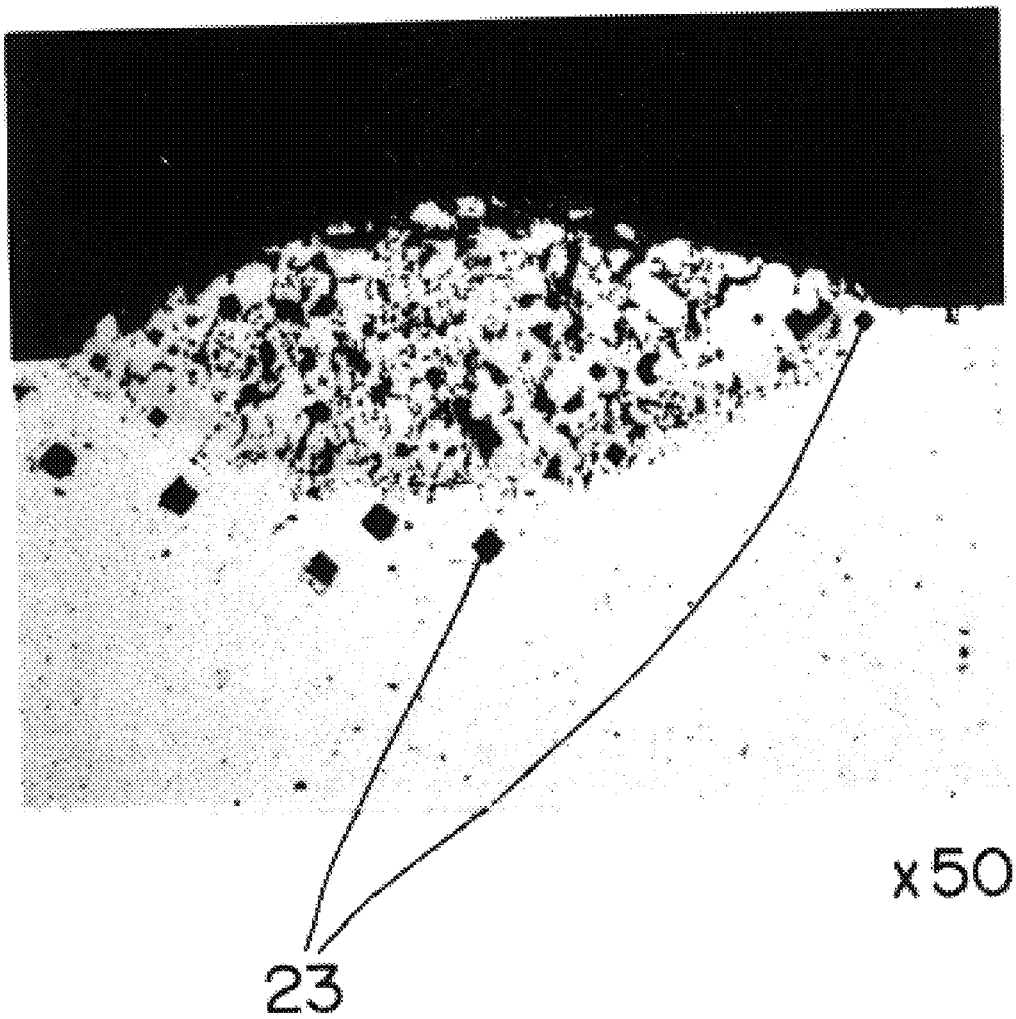
FIG. 7 is photomicrograph (at a magnification of 50 diameters) illustrating a cross section of a surface layer of a sintered alloy formed in the Example.

A photomicrograph of a section in the neighborhood of the surface of the sintered alloy 15 thus obtained is shown in FIG. 7. The rhombic black marks 23 seen in this photomicrograph are impressions left after the measurement of Vickers hardness.

When the Vickers hardness of this sintered alloy 15 was measured, it was HV180 for the base metal and HV700 for the intermetallic compound 20 of aluminum and iron, indicating that the intermetallic compound was much harder than the base metal. Moreover, the aforesaid intermetallic compound 20 was a porous body having a multitude of pores 22 formed therein. Since the penetration of oil into these pores 22 creates an oil reservoir, the surface of the intermetallic compound 20 functions as a sliding member.

It is to be understood that the present invention is not limited to the above-described embodiments, but various changes and modifications may be made on the basis of the technical idea of the present invention.

Figure 8A:
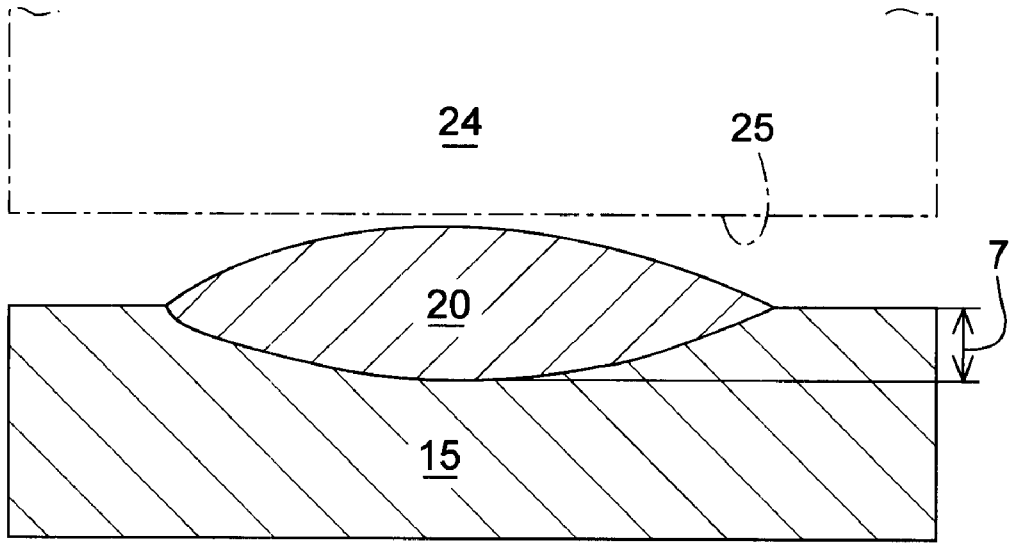
FIG. 8(*a*) is a cross-sectional view illustrating a single large-sized intermetallic compound region formed in a surface layer of a compact, and FIG. 8(*b*) is a cross-sectional view illustrating the intermetallic compound of FIG. 8(*b*) whose top surface has been made flat by grinding.
Figure 8B:
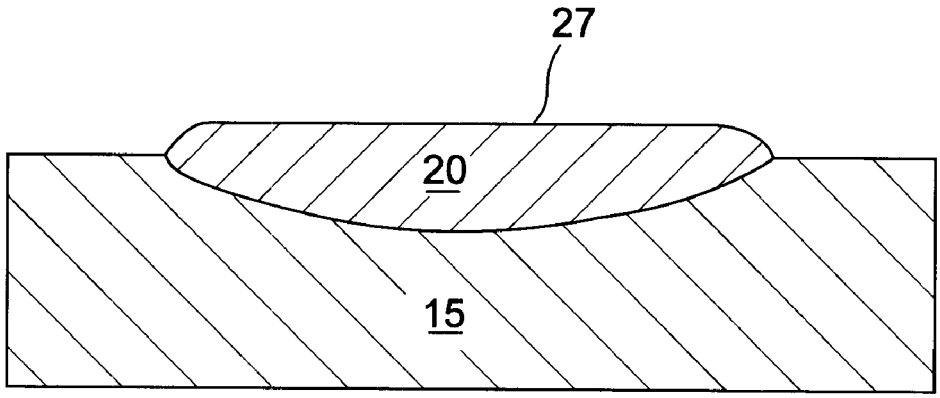
Figure 9:
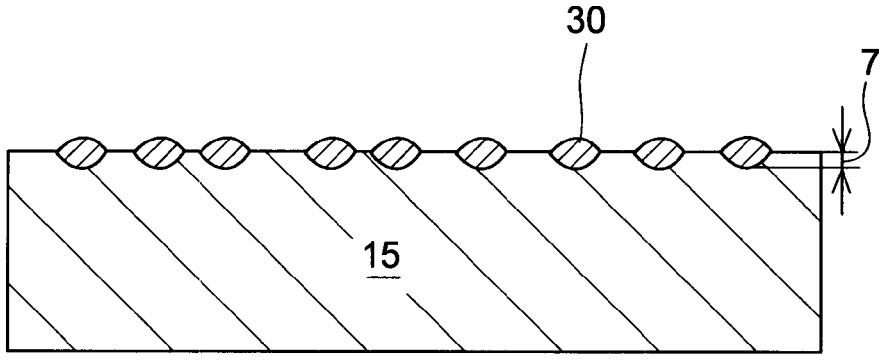
FIG. 9 is a cross-sectional view illustrating a plurality of small-sized intermetallic compound regions formed in a surface layer of a compact.
Figure 10A:
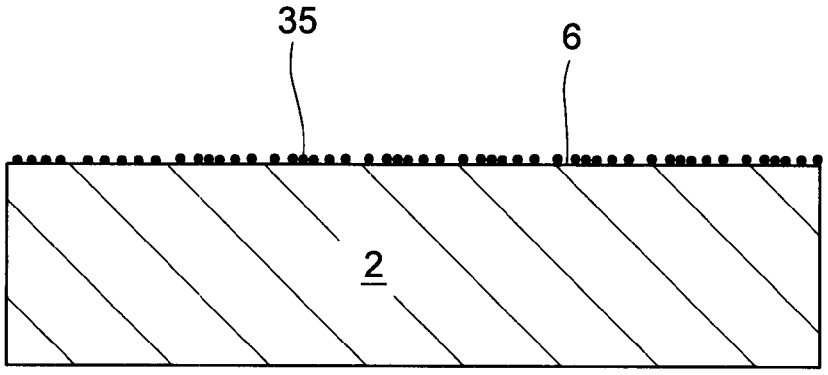
FIG. 10(*a*) is a cross-sectional view of a compact having a powdered aluminum alloy scattered over the top surface thereof, and FIG. 10(*b*) is a cross-sectional view of a sintered alloy having an intermetallic alloy layer formed on the surface of the compact of FIG. 10(*a*).
Figure 10B:
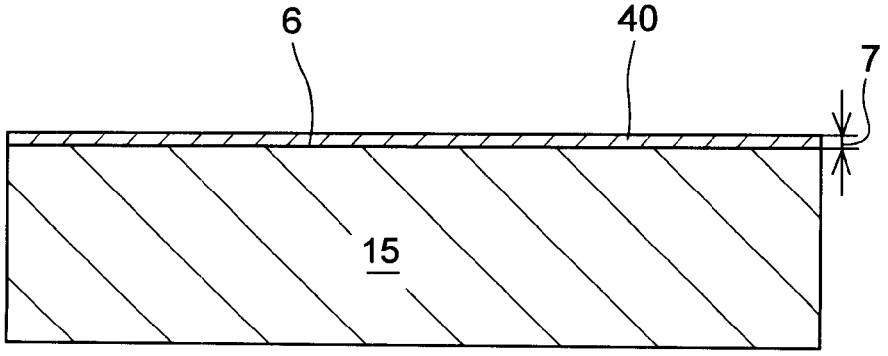

For example, FIG. 8(*a*) illustrates an embodiment in which a sintered alloy 15 in accordance with the present invention is used as a sliding member and a mating member 24 coming into contact with the sintered alloy 15 has a flat surface 25. In this embodiment, after an intermetallic compound 20 is formed in a surface layer 7, the upper part of the intermetallic compound 20 may be ground to form a flat top surface 27 as illustrated in FIG. 8(*b*). Moreover, as illustrated in FIG. 9, a plurality of small-sized intermetallic compound regions 30 may be formed in a surface layer 7 of a sintered alloy 15. In this case, it is not always necessary to grind the upper parts of the intermetallic compound regions 30 and thereby form a flat surface. Furthermore, as illustrated in FIG. 10(*a*), it is also possible to place a powder 35 of aluminum or an aluminum alloy on a surface 6 of a compact 2, spray an aqueous solution of PVA (polyvinyl alcohol) onto the compact 2 so as to prepare a paste, and then sinter the compact 2 having the surface 6 coated with this paste. Thus, as illustrated in FIG. 10(*b*), an intermetallic compound layer 40 having a uniform thickness can be formed in a surface layer 7 of a sintered alloy 15.

In addition, the hardening treatment in accordance with the present invention may preferably be applied to sintered articles such as crank pulleys and timing belt gears, and cast iron articles such as locker arm chips and cam shaft lobes.

What is claimed is:

1. A method for the hardening treatment of a sintered alloy, which comprises the steps of:

compressing an iron-based sinterable material to form a compact;

providing a surface of said compact with a coating material containing aluminum or an aluminum alloy that melts at a temperature lower than the sintering temperature of said compact; and sintering said compact provided with the coating material, so as to form an intermetallic compound of iron and aluminum in a surface layer of said compact.

2. A method for the hardening treatment of a sintered alloy as claimed in claim 1, wherein the coating material comprises a dispersion of a powder of aluminum or an aluminum alloy in a solvent or a member formed of aluminum or an aluminum alloy.

3. A sintered alloy having been subjected to a hardening treatment according to the method of claim 1.

4. A method for the hardening treatment of a sintered alloy as claimed in claim 1, wherein the intermetallic compound comprises a porous body.

5. A method for the hardening treatment of a sintered alloy as claimed in claim 4, wherein the coating material comprises a dispersion of powder of aluminum or an aluminum alloy in a solvent or a member formed of aluminum or an aluminum alloy.

6. A sintered alloy having been subjected to a hardening treatment according to the method of claim 2.

7. A sintered alloy having been subjected to a hardening treatment according to the method of claim 4.

* * * * *